US006446340B1

(12) United States Patent
Ping

(10) Patent No.: US 6,446,340 B1
(45) Date of Patent: Sep. 10, 2002

(54) UTILITY KNIFE

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 09/712,484

(22) Filed: Nov. 14, 2000

(51) Int. Cl.[7] ..... B26B 1/08
(52) U.S. Cl. ..... 30/125; 30/162; 30/335
(58) Field of Search ..... 30/125, 162, 335

(56) References Cited

U.S. PATENT DOCUMENTS

| | | | | |
|---|---|---|---|---|
| 2,172,072 A | | 9/1939 | Rothschild | |
| 2,467,481 A | | 4/1949 | Huff | |
| 2,967,354 A | | 1/1961 | Ahlborn | |
| 3,316,635 A | | 5/1967 | Merrow | 30/162 |
| 3,577,637 A | | 5/1971 | Braginetz | 30/162 |
| 3,660,896 A | | 5/1972 | Umholtz | 30/162 |
| 3,708,881 A | | 1/1973 | Bennett | 30/320 |
| 3,845,554 A | | 11/1974 | Joanis | 30/125 |
| 4,005,525 A | | 2/1977 | Gringer | 30/125 |
| 4,196,515 A | | 4/1980 | Sugiyama | 30/162 |
| 4,242,795 A | | 1/1981 | Rollband | 30/162 |
| 4,277,888 A | | 7/1981 | Szabo | 30/162 |
| 4,320,576 A | | 3/1982 | Beermann | 30/162 |
| 4,517,741 A | | 5/1985 | Castelluzzo | 30/162 |
| 4,761,882 A | | 8/1988 | Silverstein | 30/162 |
| 4,813,132 A | | 3/1989 | Castelluzzo | 30/162 |
| 4,941,260 A | | 7/1990 | Castelluzzo | 30/162 |
| 5,613,300 A | | 3/1997 | Schmidt | 30/125 |
| 5,644,843 A | | 7/1997 | Young | 30/124 |
| 5,870,828 A | | 2/1999 | Polites | 30/162 |
| 5,909,930 A | * | 6/1999 | Ragland, III et al. | 30/125 |
| 6,233,830 B1 | * | 5/2001 | Lamond et al. | 30/123 |

FOREIGN PATENT DOCUMENTS

| | | |
|---|---|---|
| CN | 99227745.0 | 5/2000 |

* cited by examiner

*Primary Examiner*—Hwei-Siu Payer
(74) *Attorney, Agent, or Firm*—Joseph J. Previto

(57) ABSTRACT

A utility knife comprising a casing, blade moving mechanism slidably mounted within the casing, the blade storage in the casing, the blade storage comprising a guide finger under which blades are stacked and along which blades are slidably movable. The blade moving mechanism is adapted to be moved to a position opposite the guide finger and a mechanism for advancing blades toward the blade moving mechanism along the guide finger. The blade moving mechanism having a blade pickup finger and the blade moving mechanism adapted to move a blade off of the guide finger and on to the blade pick up mechanism.

16 Claims, 10 Drawing Sheets

UTILITY KNIFE

BACKGROUND

The present invention relates to utility knives and more particularly to utility knives in which a new blade can be automatically replaced in the knife.

Utility knives have been in use for many years. They usually comprise a blade movable within a casing. The blade is pushed forward in order to expose the cutting edge of the blade and when desired the blade may be withdrawn within the casing so that it does not pose a hazard. Some utility knives provide for the blade to be removed and automatically replaced after the cutting edge becomes dull or for some other reason. Many of these utility knives comprise complicated mechanisms for exposing and retracting the blade and for removing and replacing the blade as well as for locking the blade in extended or retracted positions. Many of such utility knives are expensive to manufacture, are complex to use and are difficult to assemble.

OBJECTS

The present invention overcomes these defects and has for one of its objects the provision of an improved utility knife which is simple to use.

Another object of the present invention is the provision of an improved utility knife in which the blades can be easily placed in an extended or a retracted position.

Another object of the present invention is the provision of an improved utility knife in which blades can be easily removed and replaced automatically.

Another object of the present invention is the provision of an improved utility knife in which the blade can be easily locked in an extended or retracted position.

Another object of the present invention is the provision of an improved utility knife which is simple to use.

Another object of the present invention is the provision of an improved utility knife which is inexpensive to manufacture.

Another object of the present invention is the provision of an improved utility knife which may be easily assembled.

Other and further objects will be obvious upon the understanding of the illustrative embodiment about to be described, or which will be indicated in the appended claims, and various advantages not referred to herein, will occur to one skilled in the art upon employment of the invention in practice.

DRAWINGS

A preferred embodiment of the invention has been chosen for the purposes of illustration and description and is shown in the accompanying drawings forming a part of the specification wherein.

DESCRIPTION

Figure 4:
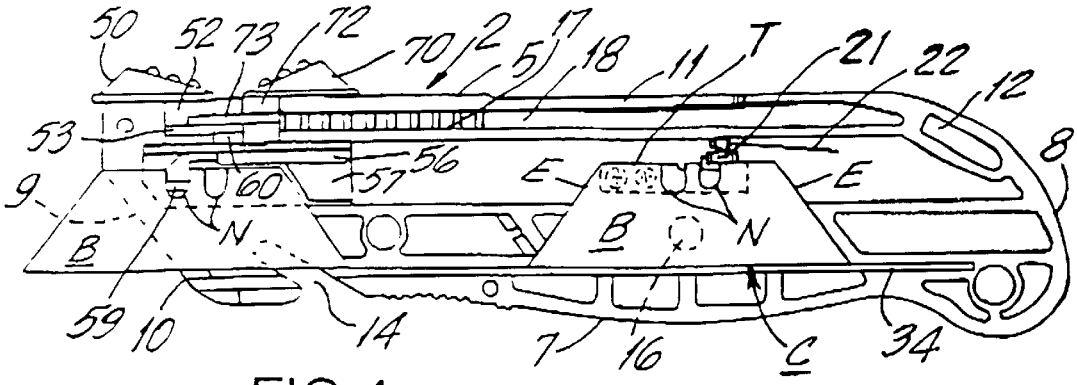
FIG. 4 is an elevational view of a first casing half of the utility knife.

The blade B preferably used with the present invention is best shown in FIG. 4 and is trapezoidal in shape having a lower cutting edge C, inwardly inclined end edges E and a shorter top edge T having a pair of notches N. It will be understood that other blades may also be used with the present invention.

Figure 1:
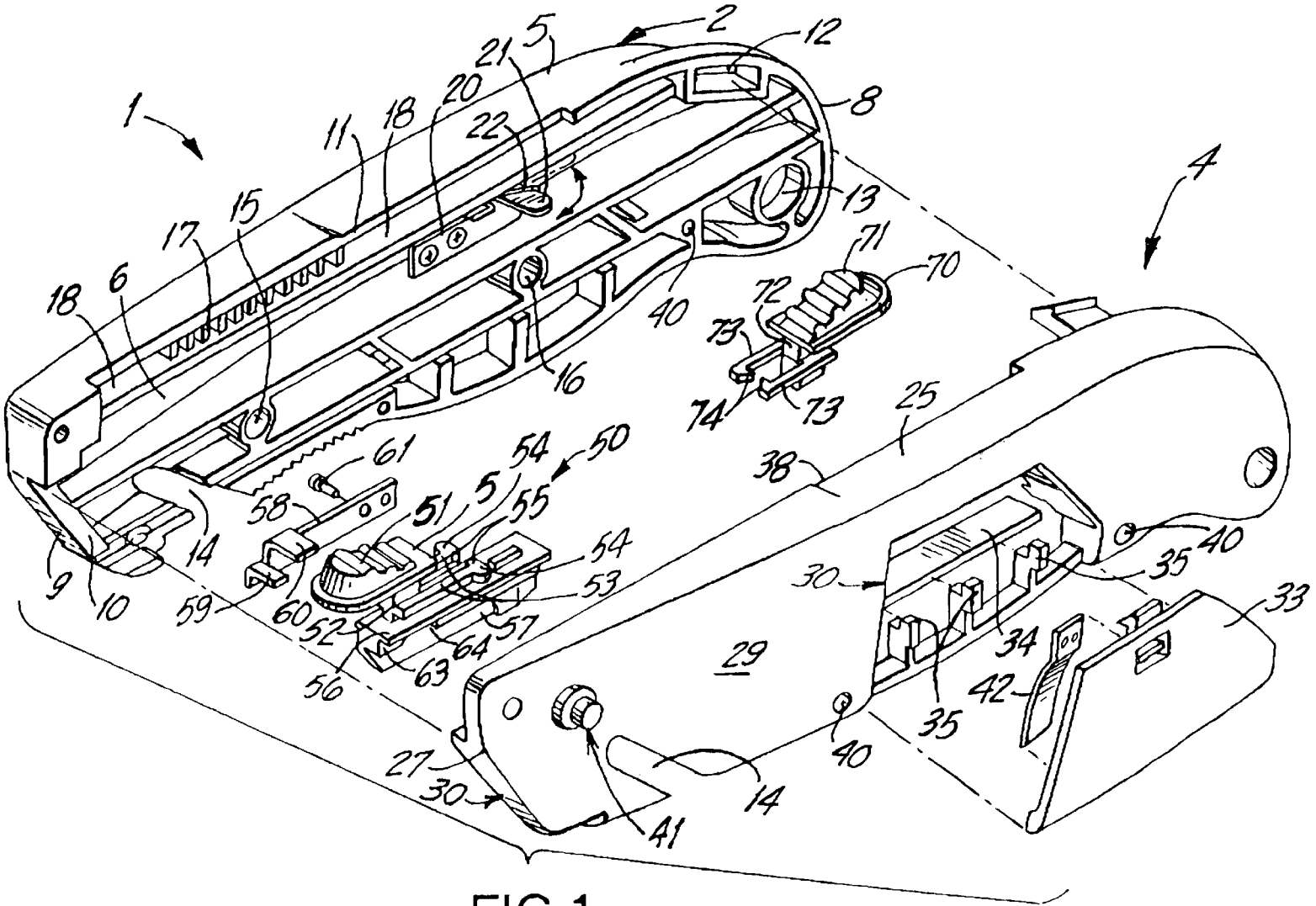
FIG. 1 is an exploded perspective view of a utility knife made in accordance with the present invention.
Figure 2:
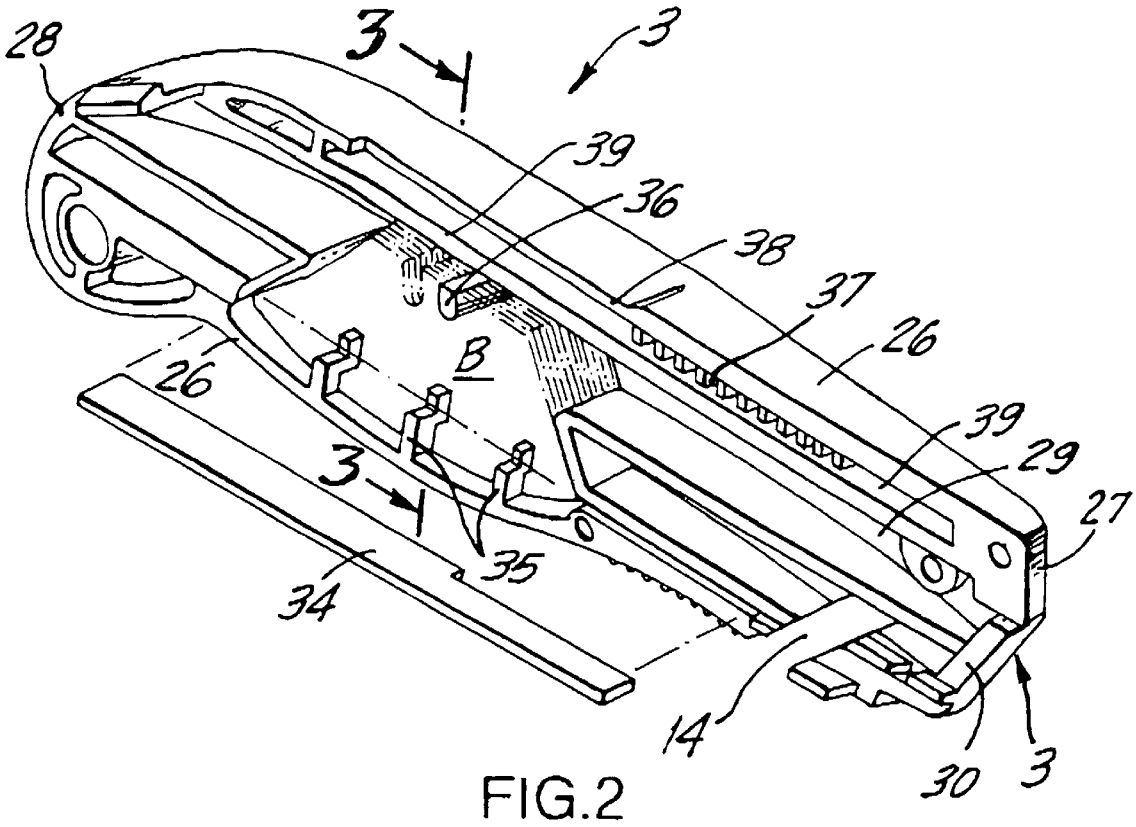
FIG. 2 is a perspective view of the second casing half of the utility knife of the present invention.
Figure 3:
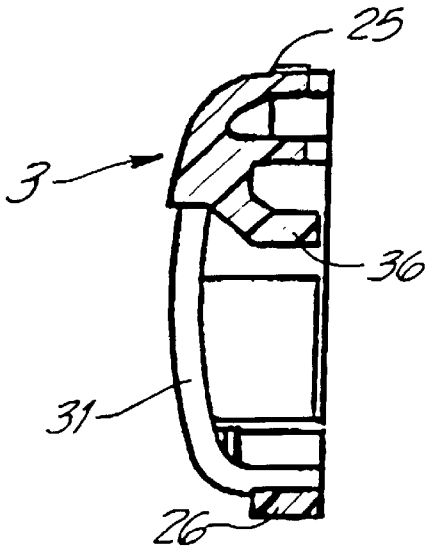
FIG. 3 is a sectional view taken along line 3—3 of FIG. 2.
Figure 5:
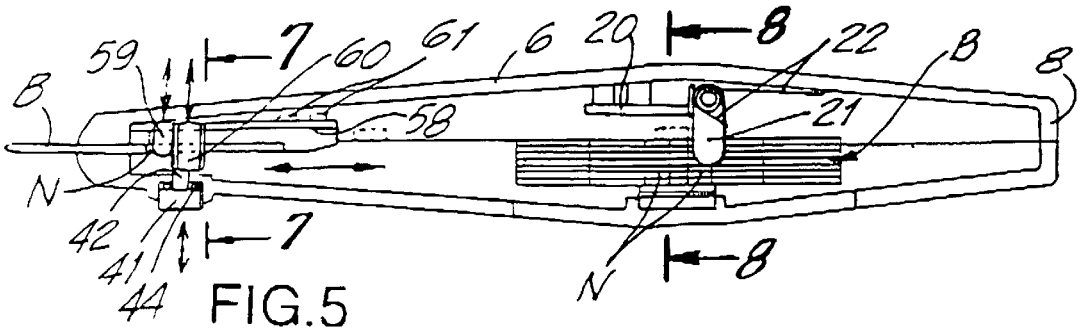
FIG. 5 is a top view of the interior of the utility knife showing the position of some of the parts when the blade is in extended position.
Figure 6:
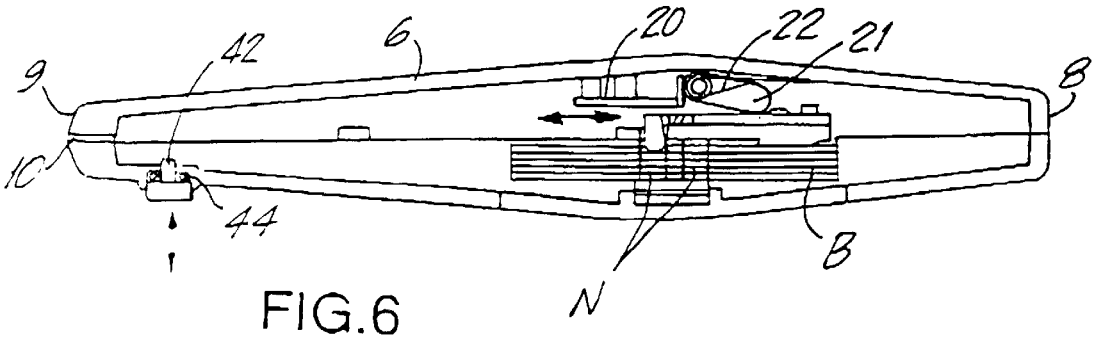
FIG. 6 is a top view similar to FIG. 4 showing the position of some of the parts when a new blade is to be added.
Figure 7:
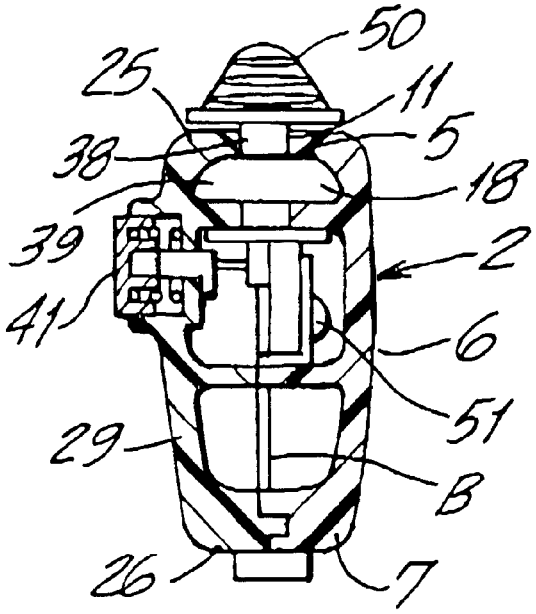
FIG. 7 is a sectional view taken along line 7—7 of FIG. 5.
Figure 8:
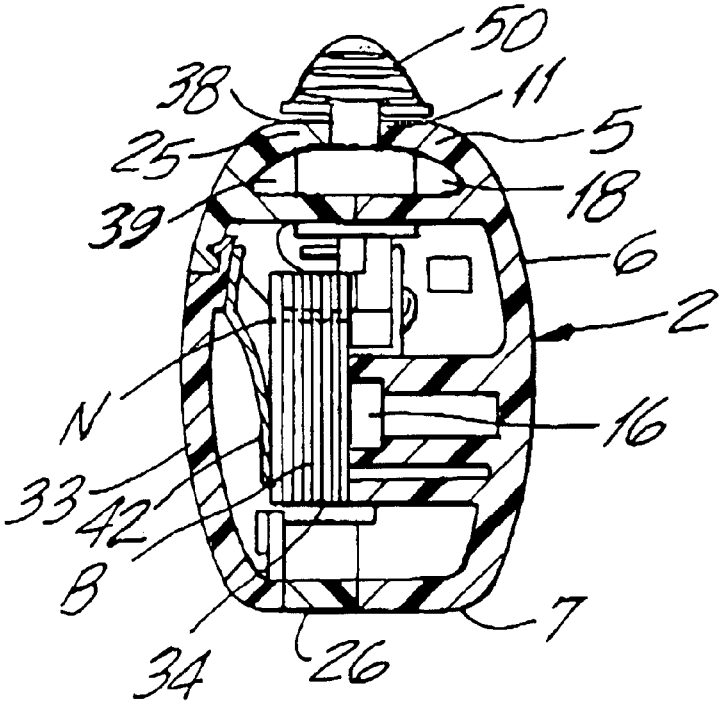
FIG. 8 is a sectional view taken along line 8—8 of FIG. 5.
Figure 9:
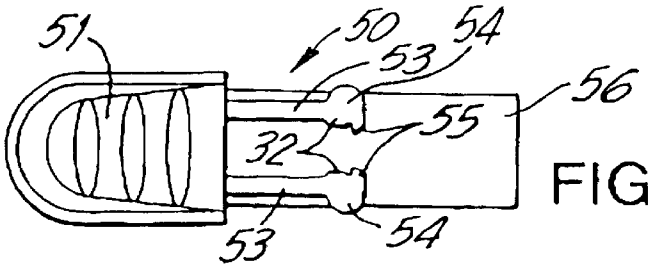
FIG. 9 is a top plan view of a blade moving slide used with the present invention.
Figure 12:
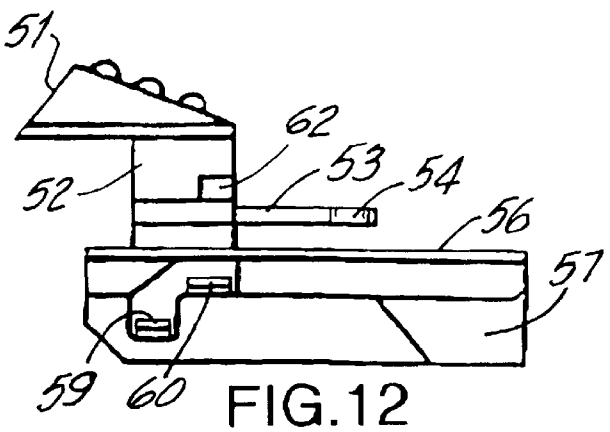
FIG. 12 is a plan view of one side thereof.
Figure 11:
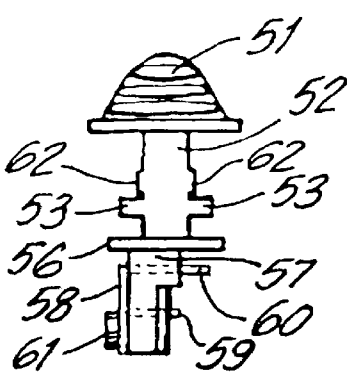
FIG. 11 is a rear plan view thereof
Figure 13:
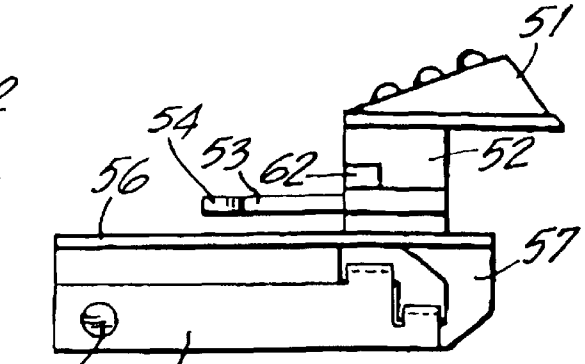
FIG. 13 is a plan view of the other side thereof.
Figure 10:
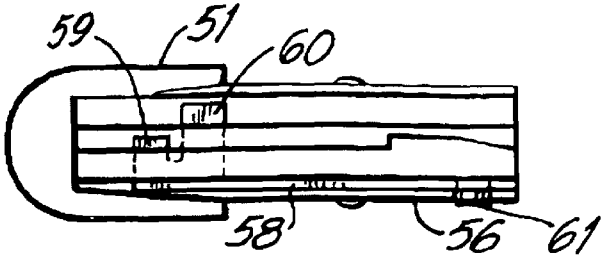
FIG. 10 is a bottom plan view thereof.

Referring to the drawings and more particularly to FIGS. 1, 2 and 3 the utility knife 1 of the present invention comprises a first casing half 2 and a second casing half 3 which are assembled together to form the complete casing 4. The first casing half 2 has a side wall 6, a top wall 5, a bottom wall 7, a rear wall 8, and a front wall 9. The front wall 9 is angled with a partial mouth slot 10. The top wall 6 has an elongated partial slide slot 11 therein. The rear wall 8 has a slot 12 in its upper end and an opening 13 at its lower end. The side wall 6 is also provided with an angled twine cutting slot 14 near its if front wall 9. A plurality of magnets 15 and 16 may also be provided in side wall 6 to hold the blades B in place. The side wall 6 has a blade leveling assembly 20 on which a pivoted blade leveling arm 21 is mounted. The blade leveling arm 21 is spring pressed by spring 22 to a position at right angles to the blade leveling assembly 20 (FIG. 5) but is pivotable to a position in lengthwise alignment with and over the blade leveling assembly 20 (FIG. 6). The side wall 6 below the top wall 5 is provided with a plurality of lock notches 17 and an undercut of elongated slide groove 18 on each side thereof.

The second casing half 3 comprises a top wall 25, bottom wall 26, front wall 27, rear wall 28 and side wall 29. The front wall 27 is angled and has a partial mouth slot 30 adapted to match the partial mouth slot 10 in the first casing half 2 in order to form a mouth 10–30. The side wall 29 also has a twine cutting slot 14 to match the twine cutting slot 14 in the first casing half 2. The side wall 29 has a trapezoidally shaped opening 31 to receive a plurality of blades B and which is adapted to be closed by a trapezoidally shaped cover 33. The side wall 29 also has a blade supporting platform 34 mounted on a plurality of spaced platform supports 35 and an inwardly extending blade notch guide finger 36 under which blades B are stacked with the blade notch guide finger 36 inserted in the notch N of the blades and along which blades B will slide inwardly away from the side wall 29 (FIGS. 2 and 3). The upper part of the interior of the side wall 29 has a plurality of lock notches 37 adopted to cooperate with corresponding lock notches 17 on the first casing half 2 and an undercut elongated slide groove 39 on each side thereof adapted to cooperate with matching slide groove 18 in the first casing half 2 to form slide groove 18–39. The top wall 25 has an elongated partial slide slot 38 to match the partial slide slot 11 in the first casing half 2 to form a slot 11–38. The top wall 25 has a lock hook 49 adapted to enter into the slot 12 of the top wall 5 in the first casing half 2 to hold the casings 2 and 3 together. Screw holes 40 may also be provided at various points on both casing halves 1 and 2 to hold them together. A blade ejection button 41 is provided at the front end of the side wall 29 to permit a blade B to be removed, as will be further described hereinbelow.

Blades B are stored in stacked relationships in the second casing half 3 through opening 31 and are supported by the support platform 34. They are also held in place by the magnet 16 against which they abut. When a blade B nearest the magnet 16 is removed, the other blades will be attracted toward the magnet 16 and move inwardly. The cover 33 of the opening 32 also has a spring 42 which will push the blades B inwardly against the magnet 16. The blades B are also held in place in stored and stacked positions beneath pivoted blade-leveling arm 21 which is in its extended position so that the blades B are held in place between the blade-leveling arm 21, the support platform 34, the magnet 16 and the spring 42. The blades B are held against lateral movement by the inwardly directed guide finger 36 which is inserted in one of the notches N at the top edge T of the blades B and along which the blades B slide when moving inwardly. The guide finger 36 terminates at the inner edge of the second casing half 3.

A blade moving slide 50 (FIGS. 9–13) comprises a top finger button 51 and a downwardly extending body 52 adopted to extend through and slide along slide slot 11–38 in the top wall 5–25 of the casing 4. A pair of spaced resilient lock fingers 53 extend rearwardly from the body 52. Each lock finger 53 has a stop head 54 extending away from each other, a stop tooth 55 extending toward each other and a grip edge 32 extending toward each other between the stop teeth 55 and the body 52. The lock heads 54 will normally slide in the slide grooves 18–39 in the two casing halves 2–3. A stop block 62 extends from each side of the body 52 above the lock fingers 53 for a short distance. Extending downwardly from the body 52 is an elongated platform 56 at right angles to body 52 with a downwardly extending support bar 57 at right angles to the platform 56. A resilient blade carrier 58 is attached to the support bar 57 by screw 61 and has a lower pick-up finger 59 extending inwardly through lower opening 63 in the support bar 57 and an upper blade release finger 60 also extending inwardly through upper opening 64 in the support bar 57. The blade carrier 58 is resilient so that its fingers 59 and 60 may move inwardly in and out of the openings 63 and 64 in the support bar 57.

Figure 16:
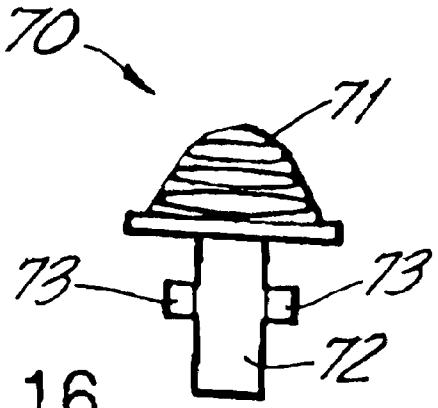
FIG. 16 is a front plan view thereof.
Figure 15:
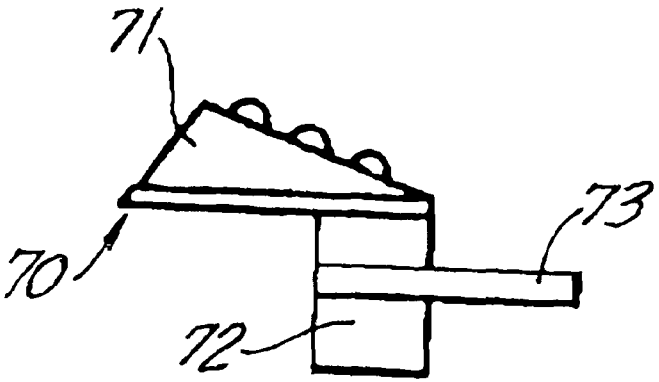
FIG. 15 is a side plan view thereof.
Figure 14:
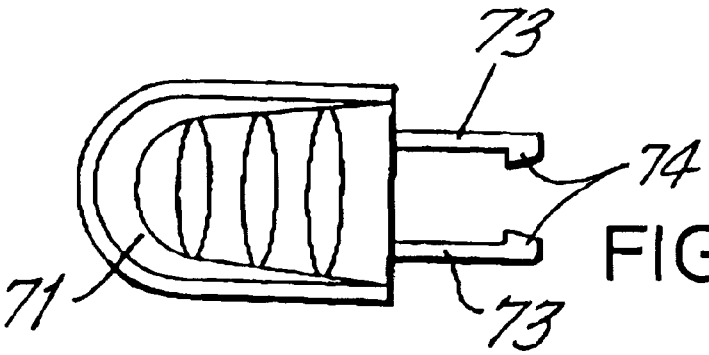
FIG. 14 is a top plan view a control slide used with the present invention.
Figure 17:
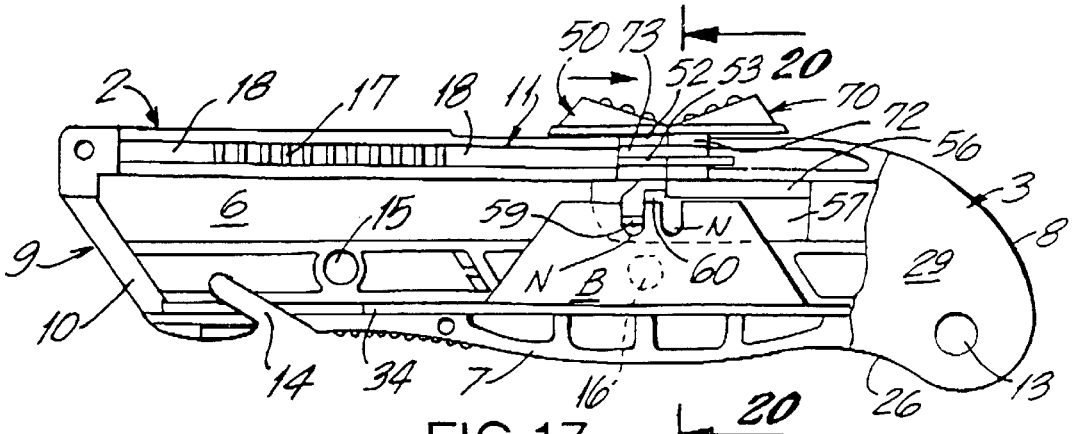
FIG. 17 is a side plan view partly broken away showing the utility knife in the process of receiving a new blade.
Figure 18:
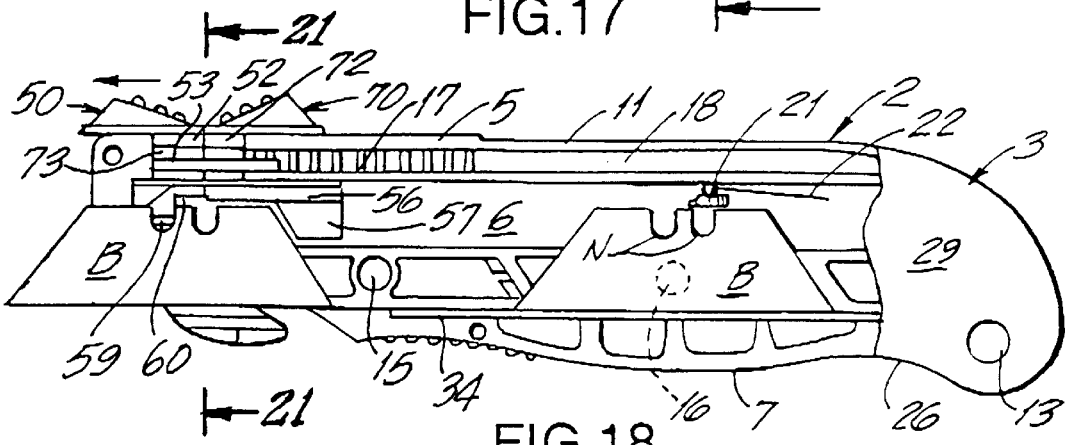
FIG. 18 is a side plan view similar to FIG. 17 showing the blade in its extended position.
Figure 19:
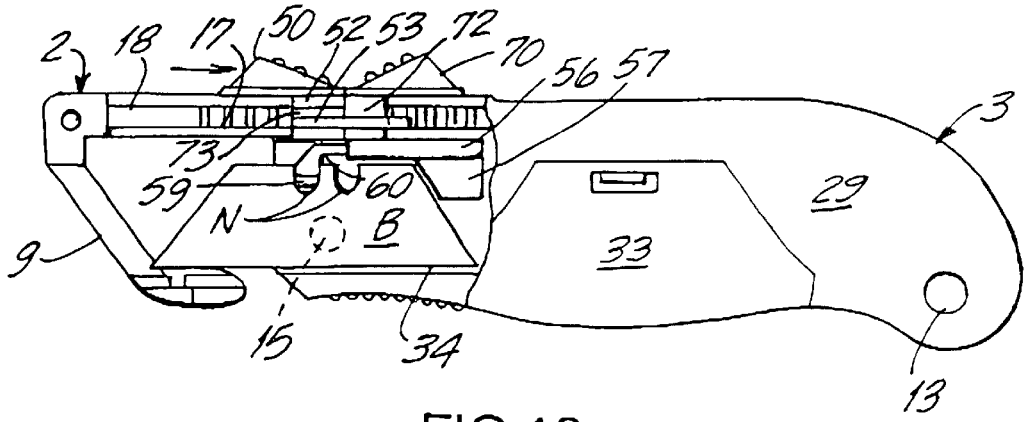
FIG. 19 is a side plan view similar to FIG. 18 showing the blade in its retracted position.
Figure 23:
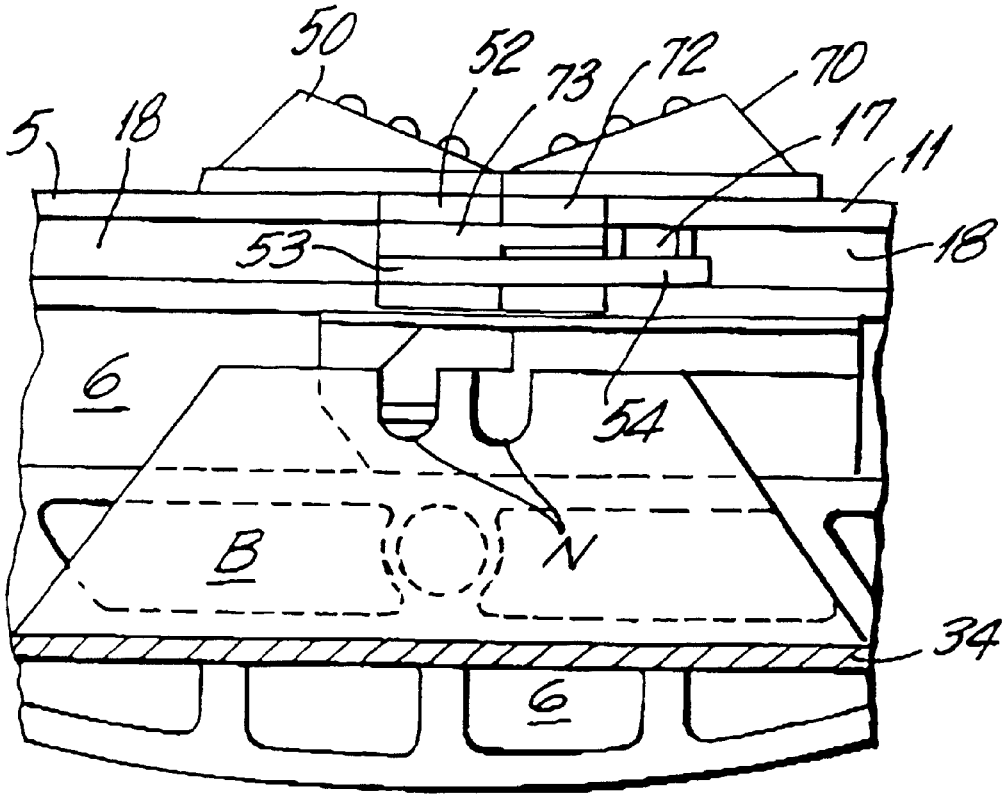
FIG. 23 is a side plan view similar to FIG. 22 showing the position of the parts when the blade is locked in its retracted position.
Figure 20:
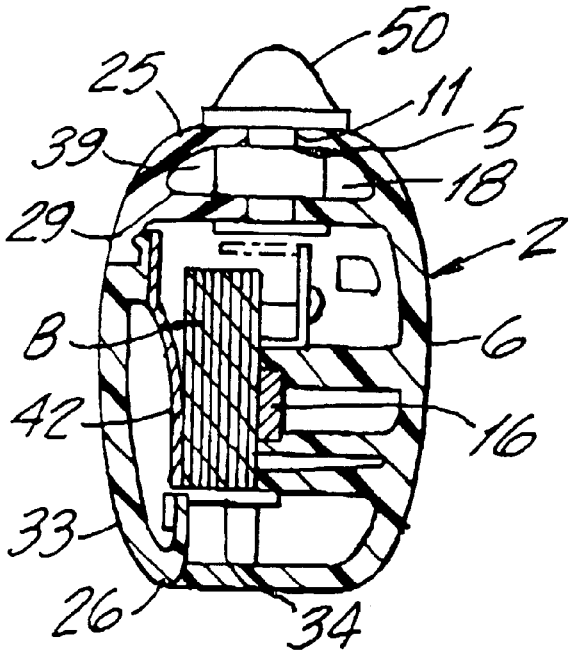
FIG. 20 is a sectional view taken along line 20—20 of FIG. 17.
Figure 22:
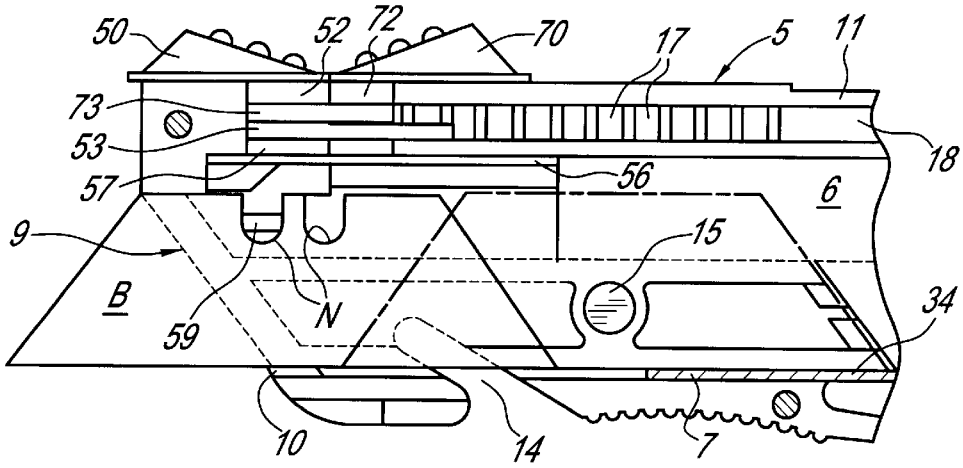
FIG. 22 is a fragmentary side plan view showing the position of the parts when the blade is locked in its extended position.

A control slide 70 (FIGS. 14–16) has a top finger button 71 and a downwardly extending body 72 which slides in slide slot 11–38 in the top wall of the casing. The body 72 has a pair of gripping arms 73 extending forwardly therefrom. Each gripping arm 73 has a stop 74 extending inwardly toward each other. The space between the gripping arms 73 is equal to or is greater than the distance between the stop block 62 on the body 52 of blade moving slide 50. The distance between grip edges 32 on the lock arms 53 is less than the thickness of the body 52 of blade moving slide 50. The distance between the grip edges 32 and the body 72 on central slide 70 is approximately equal to the length of the body 52 of the blade moving slide 50.

Figure 25:
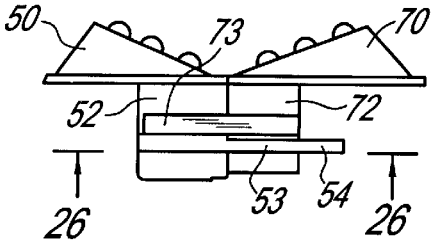
FIG. 25 is a schematic plan view showing the relationship of the slides when assembled together.
Figure 27:
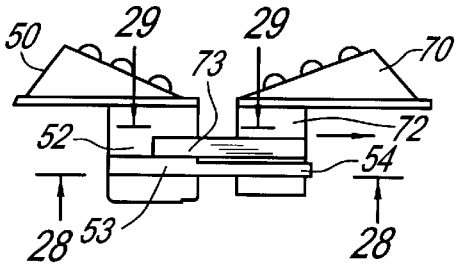
FIG. 27 is a schematic plan view showing the relationship of the slides when the blade is locked in position.
Figure 26:
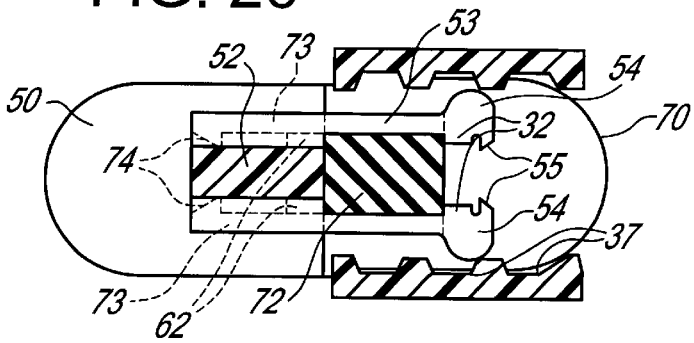
FIG. 26 is a sectional view taken along line 26—26 of FIG. 25.
Figure 21:
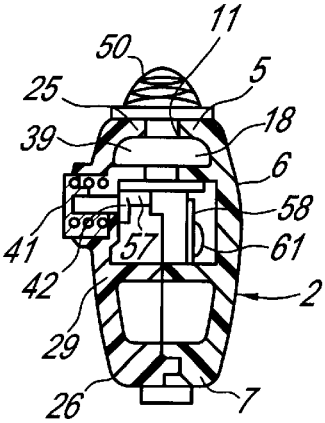
FIG. 21 is a sectional view taken along line 21—21 of FIG. 18.
Figure 28:
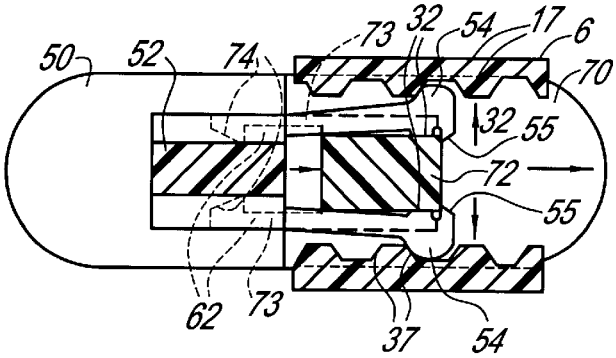
FIG. 28 is a sectional view taken along line 28—28 of FIG. 27.
Figure 24:
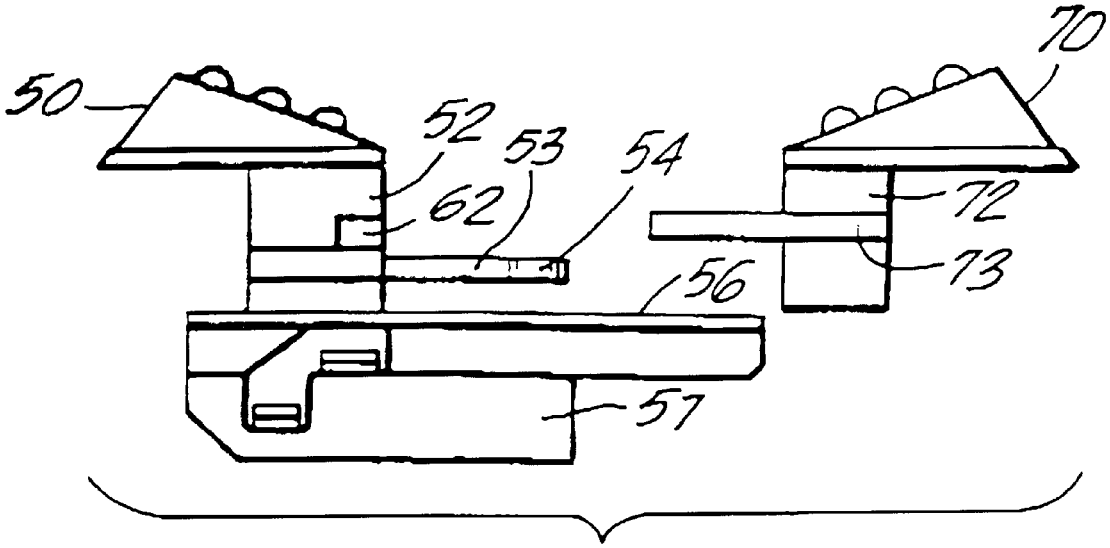
FIG. 24 is a schematic side view showing the relationship of the slides before being assembled together.
Figure 29:
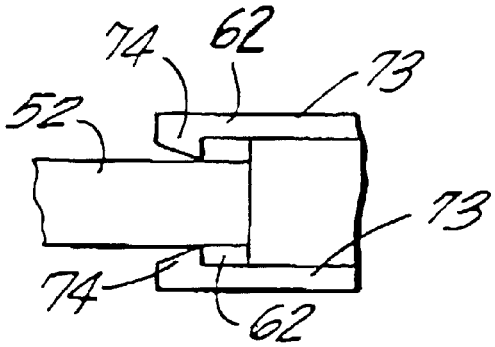
FIG. 29 is a sectional view taken along line 29—29 of FIG. 27.

The two slides 50 and 70 are adapted to face each other and slide in the slide slot 11–38 with their lock fingers 53 and gripping arms 73, respectively, pointing toward each other and slidable adjacent slide grooves 18–39. As shown in FIG. 24, 25 and 27, when the slides 50 and 70 face each other the lock fingers 53 of the blade moving slide 50 are located below the gripping arms 73 of the control slide 70. The lock fingers 53 closely embrace the body 72 of control slide 70 so that the two slides 50 and 70 can move together, i.e. the body 72 of the control slide 70 is held between body 52, arms 53 and grip edges 32 of blade moving slide 50. The control slide 70 can be separated slightly from the blade moving slide 50 since the flexibility of the grip fingers 53 will permit the body 72 thereof to move between grip edges 32. This will spread grip finger 53 apart with the body 72 being held there by stop heads 54, as will be more fully disclosed hereinafter.

In order to pick up a new blade B the two slides 50 and 70 are moved together rearwardly toward the stack of blades. The body 52 of the blade moving slide 50 lies in front of the body 72 of the control slide 70 between lock fingers 53 but does not exert any outward force on the lock fingers 53. When the slides 50 and 70 are moved adjacent to the stack of stored blades B, the slide 70 moves the pivoted blade leveling arm 21 out of the way to its folded position to free the stored blades B from any top pressure. The body 72 of the control slide 70 bears against the blade leveling arm 21 and keeps it in its folded position. In this position the spring 42 in the cover 33 will move the blades B inwardly along the guide finger 36 toward magnet 16 so that the innermost blade is moved off the end of the guide finger 36 and onto the pick-up finger 59 of the resilient blade carrier 58 which is in its extended position through lower opening 63 which is inserted in the notch N and holds the blade B in place. When the slides 50 and 70 are moved forward, the pickup finger 59 will move the blade B forward to a position adjacent magnet 15. The body 72 of control slide 70 releases the blade leveling arm 21 which returns to its normal extended position by means of spring 22. The blade B is held steady because its upper edge is held by the pickup finger 59 in one of the notches N and by the magnet 15. In this position the slides 50–70 can be moved to the forward end of the casing 4 in order to expose the blade B . After use, the blade can be retracted back into the casing 4 by moving the slides 50–70 back.

In order to lock the blade B in a particular position (either with the blade exposed or with the blade retracted) both slides 50 and 70 are moved to the desired position. In order to lock the blade B in that position, the control slide 70 is moved back slightly away from the blade moving slide 50 so that its body 72 now moves between the grip edges 32 of two locking arms 53 of the slide 50 to spread them apart. Further rearward movement of the body 72 away from slide 50 is prevented by the stop teeth 55. The stop heads 54 are thereby moved into the lock notches 17–37 in the side walls 6–29 to lock the blade B in a position When it is desired to again move the blade to a different position, the control slide 70 is moved forward toward the control slide 50 so that its body 72 is not exerting any outward force on the grip edges 32 to thereby permit the lock fingers 53 to return to their normal positions and cause the stop heads 54 to move out of the lock notches 17–37. Hence, the two slides 50 and 70 are again free for movement together with blade B along the slide slot 11–38 and the slide groove 18–39.

A spring pressed blade ejection button 41 is mounted at the forward end of the second casing half 3 and biased outwardly by spring 44. The ejection button 41 is at the same level as the upper blade release finger 60 extending from the resilient blade carrier 58. When it is desired to remove the blade B, the blade B is placed in its most forward position so that it protrudes from the mouth 9–27. At this point the inner edge 43 of the ejection button 41 is on the same level with the upper blade release finger 60 in the blade carrier 58. When the ejection button 41 is pressed inwardly against the bias of spring 44, its inner edge 43 strikes the release finger 60 and moves it inwardly. This flexes the resilient support bar 57 inwardly to move the pick up button 59 inwardly and out of the upper notch N in the blade B. This releases the blade B and the blade B can then be removed manually from the mouth 9–30.

It will thus be seen that the present invention provides an improved utility knife in which the blades can be easily placed in an extended or retracted position, in which blades can be easily removed and replaced automatically, in which the blade can be easily locked in an extended or retracted position and which is simple to use and inexpensive to manufacture.

As many varied modifications of the subject matter of this invention will become apparent to those skilled in art from the detailed description given herein above, it will be understood that the present invention is limited only as provided in the claims appended hereto.

The embodiments of the invention in which an exclusive property or privilege is claimed are defined as follows:

1. A utility knife comprising a casing, blade moving means slidably mounted within said casing, blade storage means in said casing, said blade storage means comprising guide means under which blades are stacked and along which blades are slidably movable, said blade moving means adapted to be moved down the blade storage means to a position adjacent said guide means, means for advancing blades toward said blade moving means along said guide means, said blade moving means having blade pick-up means, said advancing means adapted to move a blade off of said guide means and on to said blade pick-up means, said blade advancing means advancing the blades in a direction substantially parallel to said guide means, said guide means comprising a guide finger and said blade pick-up means comprising a blade pick-up finger, said blade moving means comprising a blade moving slide having said pick-up finger extending therefrom, said blade moving slide comprising a finger button having a body depending from said button, said body having a platform at right angles thereto and wherein said platform has a depending support bar, a blade carrier being mounted on said support bar and wherein said pick-up finger extends from said blade carrier, said pick-up finger extending through an opening in said support bar and said body having a plurality of resilient lock fingers extending therefrom.

2. A utility knife as set forth in claim 1 wherein said resilient lock fingers have lock stop heads extending away from each other.

3. A utility knife as set forth in claim 2 wherein said resilient lock fingers have stop teeth extending inwardly therefrom.

4. A utility knife as set forth in claim 3 wherein said resilient lock fingers have grip edges which extend inwardly toward each other and are interposed between the stop teeth and said body.

5. A utility knife as set froth in claim 4 wherein the body of the slide has stop blocks extending from each side thereof.

6. A utility knife as set forth in claim 5 wherein said casing has side walls with lock notches provided on each of the side walls and wherein the stop heads of the blade moving slide are on the same plane as said lock notches.

7. A utility knife as set forth in claim 6 wherein a control slide is slidably mounted in a slot in said casing, said control slide having a finger button with a body depending therefrom and having gripping arms extending therefrom in a direction opposite to the direction of the resilient lock fingers of the blade moving slide.

8. A utility knife as set forth in claim 7 wherein said gripping arms have stops extending inwardly therefrom.

9. A utility knife as set forth in claim 8 wherein the length of the body of said control slide is approximately equal to the distance between the grip edges and the body of the blade moving slide.

10. A utility knife as set forth in claim 9 wherein the thickness of the body of said control slide is greater than the thickness between the grip edges whereby when said control slide body is moved between the grip edges, the lock fingers of the blade moving slide are spread apart so that stop heads are inserted into the lock notches in the sides of the casing to lock the slides in position.

11. A utility knife as set forth in claim 10 wherein the sipping arms on the control slide are adapted to embrace the stop blocks on the blade moving slide in order to permit the two slides to move together.

12. A utility knife as set forth in claim 11 wherein said blade carrier is resilient and has a blade release finger extending therefrom, said blade release finger extending through the support bar of the blade moving slide.

13. A utility knife as set forth in claim 12 wherein a blade ejection button is mounted on the casing at the level of the blade release finger whereby inward movement of the blade ejection button will flex the support bar inwardly and move the guide finger out of a blade notch of the blade to release the blade and permit removal of the blade.

14. A utility knife as set forth in claim 13 wherein said storage means in a storage area in said casing, said casing has a cover over said storage area, said cover having an inwardly directed spring whereby blades are advanced inwardly by said spring when a blade is removed from the stack.

15. A utility knife as set forth in claim 14 wherein a leveling mechanism is provided in said casing adjacent the storage area.

16. A utility knife as set forth in claim 15 wherein said leveling mechanism comprises a pivotable arm bar adapted to overlay the stack of blades in said storage means and adapted to be swung out of the way by the slides when the slides are in a blade pick up position adjacent the storage area.

* * * * *